US011542758B1

(12) United States Patent
Liu et al.

(10) Patent No.: US 11,542,758 B1
(45) Date of Patent: Jan. 3, 2023

(54) LINKAGE TEST APPARATUS FOR DEEPWATER DRILLING RISER AND HANG-OFF SYSTEM

(71) Applicant: China University of Petroleum, Qingdao (CN)

(72) Inventors: Xiuquan Liu, Qingdao (CN); Yanwei Li, Qingdao (CN); Hexiang Sun, Qingdao (CN); Zhaowei Liu, Qingdao (CN); Xianglei Wang, Qingdao (CN); Guoming Chen, Qingdao (CN); Yuanjiang Chang, Qingdao (CN); Liangbin Xu, Qingdao (CN); Chaowei Li, Qingdao (CN); Leixiang Sheng, Qingdao (CN)

(73) Assignee: China University of Petroleum, Qingdao (CN)

( * ) Notice: Subject to any disclaimer, the term of this patent is extended or adjusted under 35 U.S.C. 154(b) by 0 days.

(21) Appl. No.: 17/748,402

(22) Filed: May 19, 2022

(30) Foreign Application Priority Data

Aug. 13, 2021 (CN) ..... 202110928112.3

(51) Int. Cl.
*E21B 19/00* (2006.01)
*E21B 47/007* (2012.01)

(52) U.S. Cl.
CPC ..... *E21B 19/002* (2013.01); *E21B 47/007* (2020.05); *E21B 2200/20* (2020.05)

(58) Field of Classification Search
CPC ..... E21B 19/002; E21B 19/004; E21B 19/006
See application file for complete search history.

(56) References Cited

U.S. PATENT DOCUMENTS

| | | | | |
|---|---|---|---|---|
| 7,080,689 | B2 * | 7/2006 | Guesnon | E21B 47/001 702/6 |
| 7,328,741 | B2 * | 2/2008 | Allen | E21B 19/004 702/152 |
| 8,074,720 | B2 * | 12/2011 | Radi | E21B 47/001 702/6 |
| 2013/0112421 | A1 * | 5/2013 | Pohner | E21B 19/006 166/355 |

FOREIGN PATENT DOCUMENTS

| | | | | |
|---|---|---|---|---|
| CN | 105587308 | A | 5/2016 | |
| CN | 108716371 | A * | 10/2018 | E21B 15/02 |
| CN | 111691834 | A | 9/2020 | |
| CN | 212228358 | U | 12/2020 | |
| CN | 113294098 | A | 8/2021 | |

* cited by examiner

*Primary Examiner* — Matthew R Buck

(57) ABSTRACT

The present invention relates to a linkage test apparatus for deepwater drilling riser and hang-off system. The linkage test apparatus includes a motion excitation system, a hang-off system and a riser system. The motion excitation system includes a six-degree-of-freedom excitation platform and sensors. The hang-off system includes a hydraulic cylinder actuating mechanism and a hydraulic system. The hydraulic cylinder in the hydraulic cylinder actuating mechanism is composed of an inner cylinder and an outer cylinder and it is fixed on the six-degree-of-freedom excitation platform by a spider. The inner cylinder of the hydraulic cylinder is hollow. A hang-off joint passes through the center of the inner cylinder, and a bottom of the hang-off joint is connected to the riser system via a rotating flange. The riser system is successively connected by multiple riser test joints, and the bottom is suspended with a lower marine riser package model.

6 Claims, 4 Drawing Sheets

LINKAGE TEST APPARATUS FOR DEEPWATER DRILLING RISER AND HANG-OFF SYSTEM

CROSS-REFERENCE TO RELATED APPLICATIONS

The application claims priority to Chinese patent application No. 202110928112.3 filed on Aug. 13, 2021, the entire contents of which are incorporated herein by reference.

TECHNICAL FIELD

The present invention relates to a dynamic test apparatus for marine riser in hang-off mode, in particular a linkage test apparatus for deepwater drilling riser and hang-off system.

BACKGROUND

Marine deepwater drilling riser system is the key equipment for offshore oil and gas exploration and development. When the environmental load exceeds the riser operation limit, the riser system and the blowout preventer are released into a hang-off mode. Risers in the hang-off mode is divided into a hard hang-off mode and a soft hang-off mode. In the hard hang-off mode, the top of risers is rigidly connected with a spider through an outer barrel of the telescopic joint, while the top of risers is connected with a platform through a tensioner in the soft hang-off mode. In the hard hang-off mode, the motion of the platform is directly transmitted to the top of the riser due to the rigid connection between the top of the riser and the platform. It may cause dynamic compression of the riser, resulting in local buckling instability of the riser. What's worse, the tension of risers at the top part may come to extreme, resulting in fracture of the riser. In the soft hang-off mode, the tensioner can compensate the heave motion of the platform and reduce the risk of dynamic compression or extreme tension of the riser. However, the operation of risers in the soft hang-off mode is cumbersome and difficult to implement in the face of severe sea conditions under typhoons.

In order to face with typhoon sea conditions, a hang-off system is proposed. Based on the proposed hang-off system, the coupling dynamic theory of risers and the hang-off system is analyzed to explore the performance and characteristics of the hang-off system. However, it cannot be proved whether the established theoretical dynamic model of risers and the hang-off system is accurate. It is necessary to carry out model validation analysis by experiment. However, full-scale laboratory test can hardly be carried out for the huge size of risers and the hang-off system in engineering. It is urgent to design a linkage test apparatus for deepwater drilling risers and the hang-off system. Then, coupling dynamic tests of risers and the hang-off system can be carried out, amending the theoretical dynamic model of risers and the hang-off system. Tests and the analysis of the theoretical dynamic model can guarantee the safe use of the hang-off system.

SUMMARY

In response to the above-mentioned problems, the present invention provides a linkage test apparatus for deepwater drilling riser and hang-off system, wherein the test apparatus can simulate the dynamic coupling process of risers and the hang-off system realistically. The coupling dynamic response characteristics of risers and the hang-off system can be revealed.

The present invention is achieved by the following technical solution:

A linkage test apparatus for deepwater drilling riser and hang-off system, comprising a motion excitation system, a hang-off system and a riser system;

wherein the motion excitation system comprises a six-degree-of-freedom excitation platform for simulating the motion of a marine drilling platform, a displacement sensor and an acceleration sensor;

wherein the hang-off system is divided into a hydraulic cylinder actuating mechanism and a hydraulic system; the hydraulic cylinder actuator comprises a hydraulic cylinder, a spider, a guide fixing sleeve, a clamping block, a gland, a hang-off joint, a gimbal, a rotating flange, a displacement sensor and a strain gauge; the hydraulic system includes a trip valve, a throttle valve, a two-position three-way electromagnetic reversing valve, an relief valve, a check valve, a hydraulic pump, a filter, a PLC controller, an accumulator, an oil tank, a high-performance computer, and a pressure sensor; and wherein the hydraulic cylinder is composed of an inner cylinder and an outer cylinder and is fixed to the six-degree-of-freedom excitation platform by the spider, and the inner cylinder of the hydraulic cylinder is hollow; an upper part of the hang-off joint is provided with a fixing groove; a side surface of a lower part is planar and is provided with a light hole; the hang-off joint passes through the inner cylinder of the hydraulic cylinder unobstructed and it is fixed on a top of the inner cylinder of the hydraulic cylinder by the guide fixing sleeve and the clamping block; the lower part of the hang-off joint is connected to the rotating flange by the gimbal; the high-performance computer is provided with a built-in control and monitoring system for controlling and monitoring the motion excitation system, the hang-off system and the riser system; and the PLC controller is capable of recognizing signals from the high performance computer for real time controlling and monitoring of hydraulic elements;

wherein the riser system comprises riser test joints, a lower marine riser package model, a water environment, three component force sensors and acceleration sensors; many riser test joints are successively connected to form a riser system; the lower marine riser package model is suspended at a bottom of the riser system; the three component force sensors and the acceleration sensors are distributed at a certain interval in the riser system for monitoring dynamic response of the riser system; and the riser system is mostly contained in the water environment for simulating an actual marine environment.

Further, wherein the guide fixing sleeve is U-shaped, and the bottom thereof is provided with a through hole for passing through the hang-off joint; the clamping block is crescent-shaped, and two clamping blocks are combined into a circular ring and fit with the groove of the hang-off joint; an inner diameter of the guide fixing sleeve is the same as an outer diameter of the clamping block; a group of the strain gauges are arranged on the side surface of the hang-off joint, and the group of the strain gauges has two measuring points arranged at 90 degrees for monitoring strain information; the gimbal is composed of a gimbal base and a pin shaft; upper and lower parts of the gimbal base are both U-shaped, and opening directions of the gimbal base are opposite; the angle of a tangent plane is 90 degrees, and a side face is provided with a light hole; and the gimbal connects the lower part of the hang-off joint and the rotating flange so as to realize the rotation in space.

Further, wherein the hydraulic pump is connected to the oil tank, the check valve, the relief valve, and the accumulator via a hydraulic line, and provides a hydraulic power source for the accumulator; a rod cavity of the hydraulic cylinder is connected with a rodless cavity of the hydraulic cylinder, forming a differential circuit with the throttle valve connected; two circuits are formed via the two-position three-way electromagnetic reversing valve: a circuit combining the accumulator, the two-position three-way electromagnetic reversing valve, the throttle valve and the hydraulic cylinder for pushing the inner cylinder of the hydraulic cylinder to extend, and a circuit combining the hydraulic cylinder, the throttle valve, the two-position three-way electromagnetic reversing valve, the filter and the oil tank for pushing the inner cylinder of the hydraulic cylinder to retract; the trip valves are disposed at an outlet end of the hydraulic cylinder and an outlet end of the accumulator; the displacement sensor is used for monitoring the extension length of the inner cylinder of the hydraulic cylinder; the pressure sensors are used for monitoring the pressure of the accumulator, the pressure of the rodless cavity and the rod cavity of the hydraulic cylinder.

Futher, wherein the design basis of the riser test joint and the lower marine riser package model are both dynamic similarity principles; the dynamic parameters of the test model are obtained after engineering parameters are scaled down by the same proportion, and the dynamic equation is:

$$M\ddot{x}+C\dot{x}+Kx=F$$

where M is the mass of the riser or lower marine riser package; C is the damping of the riser or lower marine riser package; K is the stiffness of the riser or lower marine riser package; F is the applied force on the riser or lower marine riser package; and x is the displacement of the riser or lower marine riser package.

Further, wherein the riser test joint is designed as multiple sections; a top part is provided with a flange, and a bottom part is provided with a threaded hole; the riser system is assembled through threaded connection, and the threaded connection between a top part of the riser system and the rotating flange is a bolt connection; the lower marine riser package model is composed of counterweight plates; a through hole is provided at the center of the counterweight plate; and a plurality of the counterweight plates are arranged and then connected together via a connecting rod; and an adapter flange is provided at a top of the lower marine riser package model and is connected to the riser system via a screw; and wherein the riser test joint and the lower marine riser package model have the features of easy assembly and disassembly and adjustable parameters.

Further, wherein signals of the displacement sensor, the acceleration sensor arranged in the motion excitation system, the three component force sensor, the acceleration sensor arranged in the riser system, the displacement sensor, the pressure sensor and the strain gauge arranged in the hang-off system are collected by a PLC controller; the throttle valve and the two-position three-way electromagnetic reversing valve are controlled by the PLC controller; the high-performance computer controls the six-degree-of-freedom excitation platform while enabling data reading and command issuing within the PLC controller.

With the above technical solution, the present invention has the following advantages: 1. based on the dynamic similarity principle, the scaled model of riser system is designed, which has the capability of data inversion, and the dynamic response characteristics of risers and the hang-off system in real ocean environment can be obtained; 2. based on various sensors, detailed experimental data of the risers and the hang-off system can be obtained by means of the combination of a PLC controller and a high-performance computer, and the theoretical model can be modified; 3. the linkage test apparatus for deepwater drilling riser and hang-off system is simple in structure, convenient in the assembly and disassembly, and allow the linkage test for a variety of riser system configurations and a variety of the hang-off system parameters; and 4. a six-degree-of-freedom excitation platform is used to provide motion, which is easy to operate and can carry out a variety of test conditions.

DETAILED DESCRIPTION OF THE EMBODIMENTS

The present invention will now be further described with reference to the accompanying drawings and examples.

Figure 2:
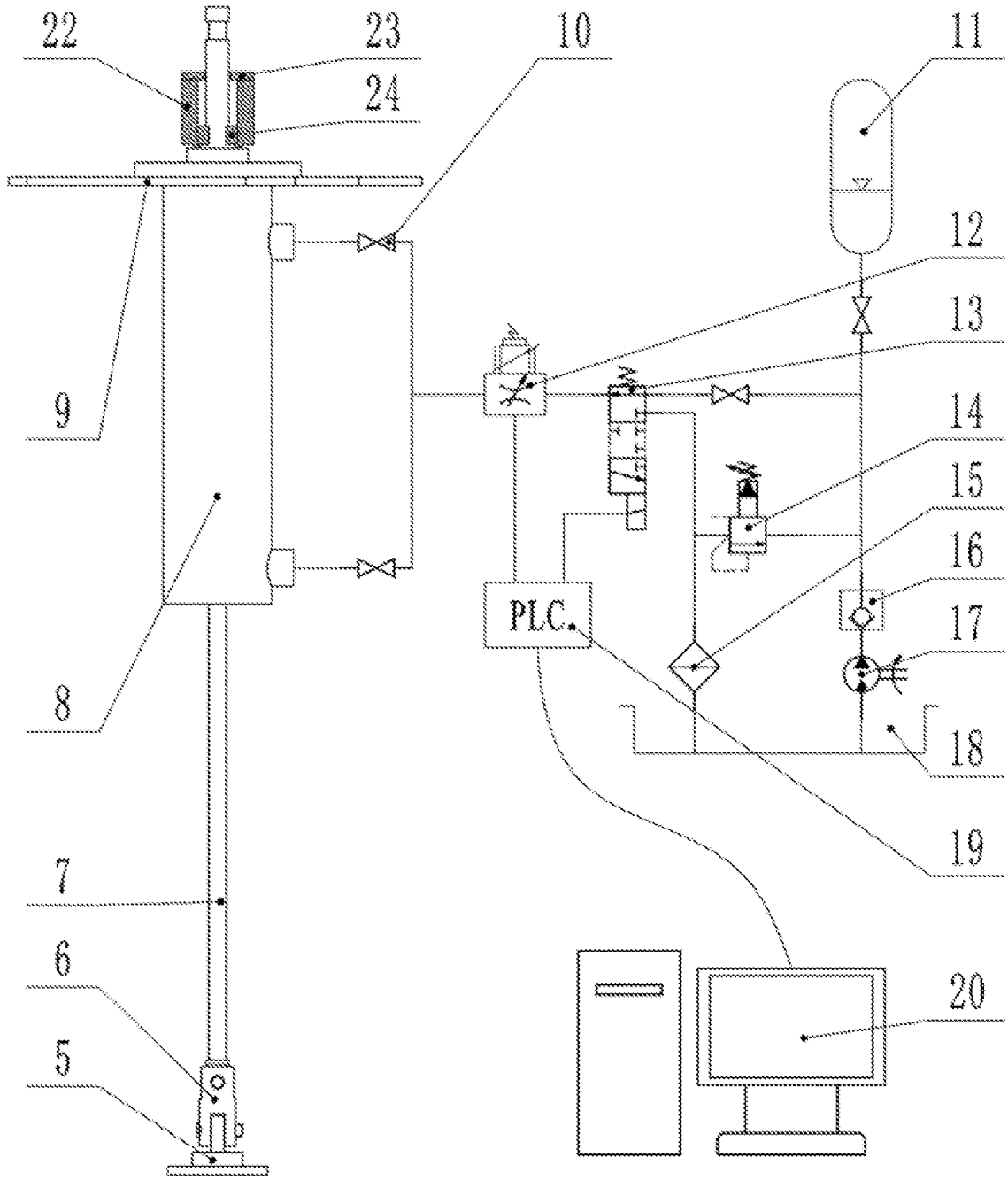
FIG. 2 is a structural schematic diagram of a hang-off system of the present invention.

As shown in FIG. 2, a hydraulic cylinder 8 is composed of an inner cylinder and an outer cylinder. The inner cylinder is hollow. A boss is provided on a top side of the outer cylinder and is mated with a spider 9. A guide fixing sleeve 22 is U-shaped, and is internally provided with a shoulder, and the bottom thereof is mated with the inner cylinder of the hydraulic cylinder 8. A groove is machined circumferentially at an upper end of the hang-off joint 7. The clamping block 24 is crescent-shaped, and two clamping blocks are combined into a circular ring and fit with the groove of the hang-off joint 7. The height of the clamping block 24 is consistent with the axial height of the groove. The diameter of the clamping block 24 is consistent with the inner diameter of the guide fixing sleeve 22. An assembly body formed by the clamping block 24 and the hang-off joint 7 passes through the inner cylinder of the hydraulic cylinder 8, and the bottom surface of the clamping block 24 is in contact with the shoulder of the guide fixing sleeve 22, which enables the load borne by the hang-off joint 7 to be transmitted to the inner cylinder of the hydraulic cylinder 8 via the clamping block 24. The gimbal 6 is composed of a gimbal base and a pin shaft. Upper and lower parts of the gimbal base are both U-shaped; the opening directions are opposite; the tangent plane angle is 90 degrees; and a side face is provided with a light hole. The gimbal 6 connects the hang-off joint 7 and the rotating flange 5 so as to realize the rotation in a space and reduce the bending moment borne by the hang-off joint 7. The hydraulic pump 17 is connected to an oil tank 18, a check valve 16, an relief valve 14 and an accumulator 11 via a hydraulic line, and provides a hydraulic power source for the accumulator 11. After the pressure in the accumulator 11 exceeds the threshold of the relief valve 14, it is drained back to the oil tank 18 via the filter 15 to ensure the safety of the system. A rodless cavity and a rod cavity of the hydraulic cylinder 8 are connected differentially. The circuit of the two-position three-way electromagnetic reversing valve 13 and the opening of the throttle valve 12 are changed by the PLC controller 19 so as to adjust the extension and retraction action and speed of the inner cylinder of the hydraulic cylinder 8. The oil pressure in the accumulator 11 is a high pressure. The hydraulic oil enters the hydraulic cylinder 8 via the two-position three-way electromagnetic reversing valve 13 and the throttle valve 12 so as to push the inner cylinder out. By changing the passage of the two-position three-way electromagnetic reversing valve 13, the hydraulic oil in the hydraulic cylinder 8 flows back to the oil tank 18 via the throttle valve 12, the two-position three-way electromagnetic reversing valve 13 and the filter 15, so that the inner cylinder is retracted. The motion of the riser system is changed by adjusting the extension and retraction action of the inner cylinder of the hydraulic cylinder 8. A trip valves 10 are arranged at an outlet end of the hydraulic cylinder 8 and an outlet end of the accumulator 11. When the hydraulic line is burst to cause oil leakage and pressure loss, the trip valve 10 is quickly closed to protect the hydraulic system and prevent the inner cylinder of the hydraulic cylinder 8 from being rapidly retracted to damage the equipment.

Figure 1:
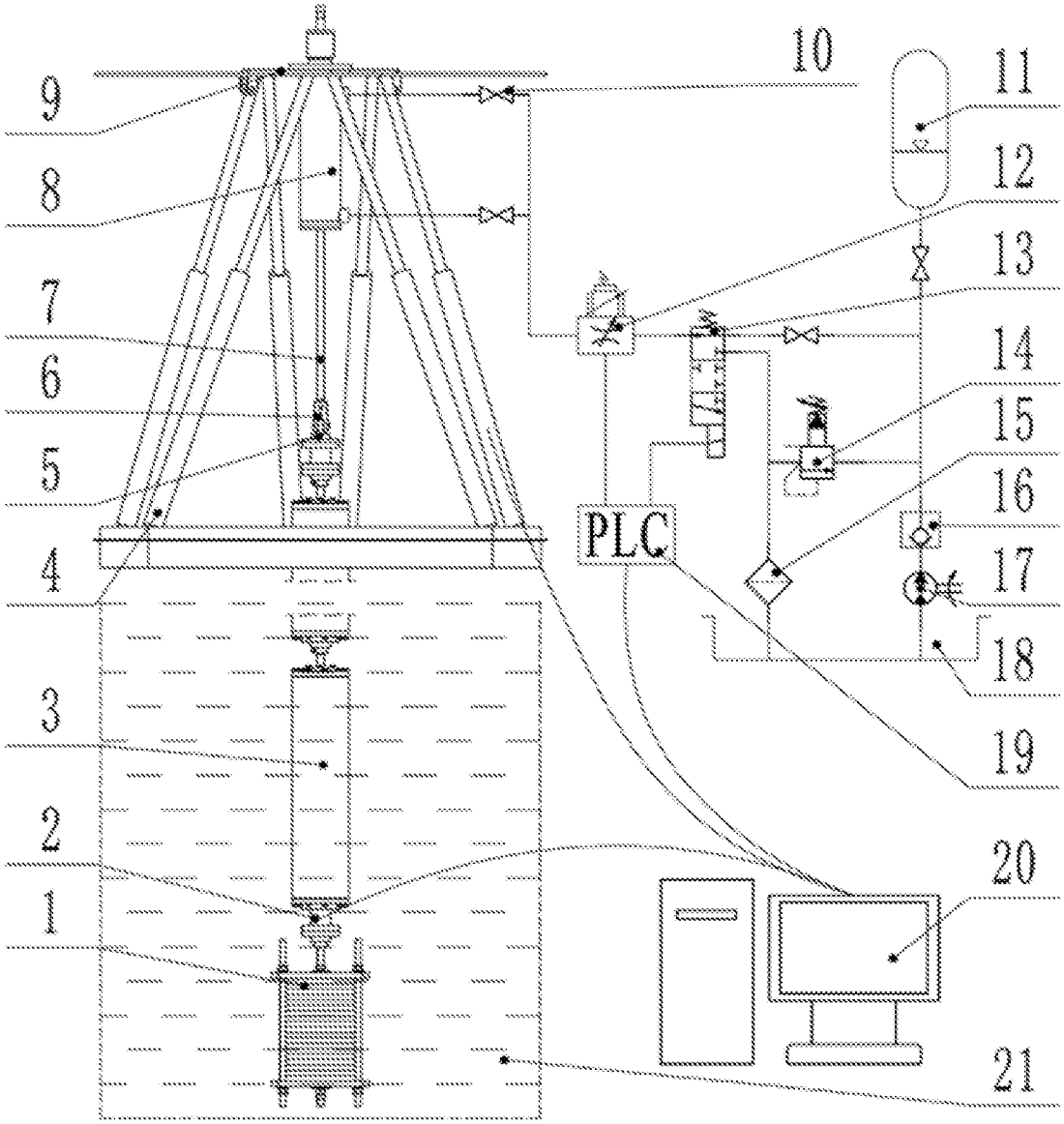
FIG. 1 is a schematic view showing an overall structure of the present invention.
Figure 3:
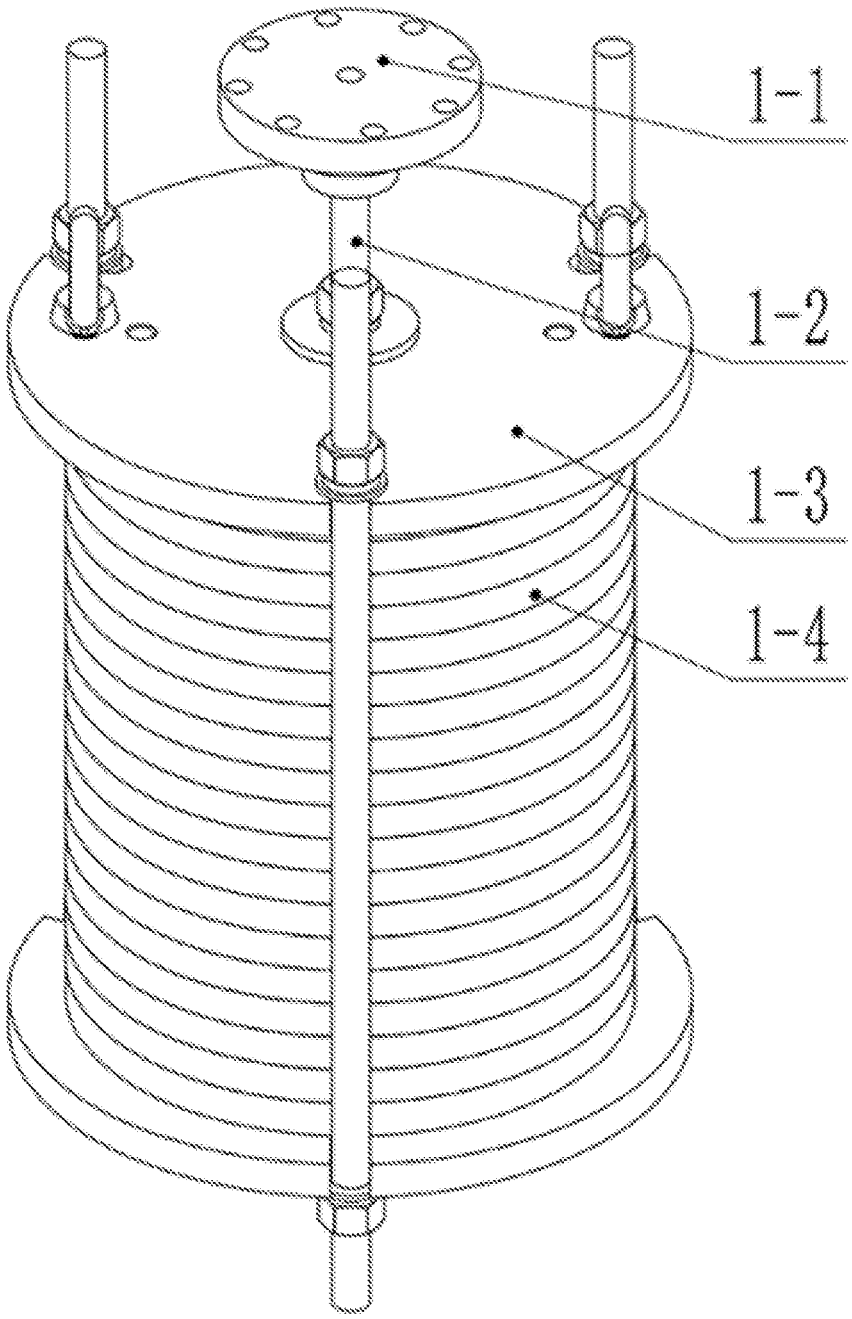
FIG. 3 is a structural schematic view of a lower marine riser package model of the present invention.

As shown in FIGS. 1 and 3, the riser system test model is designed based on the dynamic similarity principle. The center of the counterweight cover plates 1-3 and the counterweight plates 1-4 are both provided with through holes. The number of the counterweight plates 1-4 is determined according to the mass of the lower marine riser package after scaling. Two ends are provided with the counterweight cover plates 1-3. The middle is provided with the counterweight plates 1-4. The through holes are aligned and pass through the connecting rods 1-2. The two ends of the connecting rod 1-2 are provided with nuts. After fastening, the lower marine riser package model 1 is assembled. An adapter flange 1-1 is installed onto a top of the lower marine riser package model 1, and the connection mode is a threaded connection. The riser test joint 3 is designed as multiple sections, with a flange at the top and a threaded hole at the bottom. A riser system is formed by assembly in a screw connection manner. The bottom of the riser system is bolted to the adapter flange 1-1 to form the riser system. The riser system test model has the characteristics of simple structure, convenient disassembly and adjustable parameters.

As shown in FIGS. 1, 2 and 3, the top flange of the riser system is connected to a rotating flange 6 at the lower part of the hang-off joint 7 to form a combination of the riser and the hydraulic cylinder actuating mechanism. The combination is connected with the top of the six-degree-of-freedom excitation platform 4 via the spider 9. The lower part of the riser system is submerged in the water environment 21. Under the excitation of the six-degree-of-freedom excitation platform 4, the combination of the riser and the hydraulic cylinder actuator generates a vibration similar to that in an actual marine environment.

Figure 4:
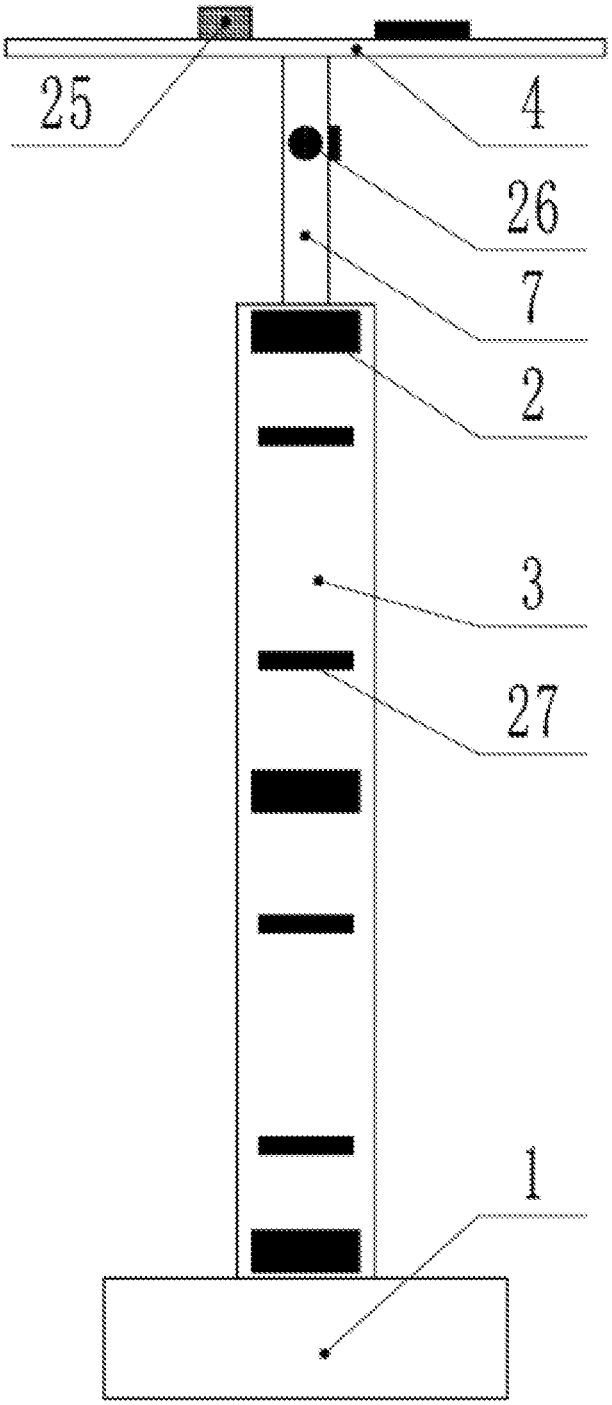
FIG. 4 is a schematic diagram of the arrangement of a mechanical structure sensor of the present invention.

As shown in FIGS. 1, 2 and 4, sensors are arranged in both the riser system and the hang-off system. Pressure sensors are arranged in both the rodless cavity and the rod cavity of the hydraulic cylinder 8 and the accumulator 11 for monitoring the oil pressure in real time. A displacement sensor is arranged at the hydraulic cylinder 8 for monitoring the extension length of the inner cylinder. A group of strain gauges 26 are arranged on the side of the hang-off joint 7. The group of strain gauges 26 has two measuring points arranged at 90 degrees for monitoring strain information. The six-degree-of-freedom excitation platform is provided with a displacement sensor 25 and an acceleration sensor 27 so as to realize accurate monitoring of the motion excitation system. A three component force sensor 2 and the acceleration sensor 27 are distributed in the riser system at a certain interval for monitoring the dynamic response information of the riser system. All the sensor signals are synchronously collected by the PLC controller 19. The high-performance computer 20 is provided with a built-in control and monitoring system for issuing instructions and transferring data to the PLC controller 19, so as to control and monitor the motion excitation system, the hang-off system and riser system.

The method of the present invention has advantageous effects of: a simple and reliable linkage test scheme for deepwater drilling riser and hang-off system is proposed. Based on the dynamic similarity principle, the riser system is designed to simulate the dynamic coupling process of risers and the hang-off system in real marine environment. The dynamic response law of risers and the hang-off system is revealed through data inversion, which provides technical support for the safe use of the hang-off system.

What is claimed is:

1. A linkage test apparatus for deepwater drilling riser and hang-off system, comprising a motion excitation system, a hang-off system and a riser system;

wherein the motion excitation system comprises a six-degree-of-freedom excitation platform for simulating the motion of a marine drilling platform, a displacement sensor and an acceleration sensor;

wherein the hang-off system is divided into a hydraulic cylinder actuating mechanism and a hydraulic system; the hydraulic cylinder actuating mechanism comprises a hydraulic cylinder, a spider, a guide fixing sleeve, a clamping block, a gland, a hang-off joint, a gimbal, a rotating flange, a displacement sensor and a strain gauge; the hydraulic system includes a trip valve, a throttle valve, a two-position three-way electromagnetic reversing valve, an relief valve, a check valve, a hydraulic pump, a filter, a PLC controller, an accumulator, an oil tank, a high-performance computer, and a pressure sensor; and wherein the hydraulic cylinder is composed of an inner cylinder and an outer cylinder and is fixed to the six-degree-of-freedom excitation platform by the spider, and the inner cylinder of the hydraulic cylinder is hollow; an upper part of the hang-off joint is provided with a fixing groove; a side surface of a lower part of the hang-off joint is planar and is provided with a light hole; the hang-off joint passes through the inner cylinder of the hydraulic cylinder unobstructed and the hang-off joint is fixed on a top of the inner cylinder of the hydraulic cylinder by the guide fixing sleeve and the clamping block; the lower part of the hang-off joint is connected to the rotating flange by the gimbal; the high-performance computer is provided with a built-in control and monitoring system for controlling and monitoring the motion excitation system, the hang-off system and the riser system; and the PLC controller is capable of recognizing signals from the high performance computer for real time controlling and monitoring of hydraulic elements;

wherein the riser system comprises riser test joints, a lower marine riser package model, a water environment, three component force sensors and acceleration sensors; the riser test joints are successively connected to form the riser system; the lower marine riser package model is suspended at a bottom of the riser system; the three component force sensors and the acceleration sensors are distributed at a certain interval in the riser system for monitoring dynamic response of the riser system; and the riser system is mostly contained in the water environment for simulating an actual marine environment.

2. The linkage test apparatus for deepwater drilling riser and hang-off system of claim 1, wherein the guide fixing sleeve is U-shaped, and the bottom thereof is provided with a through hole for passing through the hang-off joint; the clamping block is crescent-shaped, and two clamping blocks are combined into a circular ring and fit with the groove of the hang-off joint; an inner diameter of the guide fixing sleeve is the same as an outer diameter of the clamping block; a group of the strain gauges are arranged on the side surface of the hang-off joint, and the group of the strain gauges has two measuring points arranged at 90 degrees for monitoring strain information; the gimbal is composed of a gimbal base and a pin shaft; upper and lower parts of the gimbal base are both U-shaped, and opening directions of the gimbal base are opposite; the angle of a tangent plane is 90 degrees, and a side face is provided with a light hole; and the gimbal connects the lower part of the hang-off joint and the rotating flange so as to realize the rotation in space.

3. The linkage test apparatus for deepwater drilling riser and hang-off system of claim 1, wherein the hydraulic pump is connected to the oil tank, the check valve, the relief valve, and the accumulator via a hydraulic line, and provides a hydraulic power source for the accumulator; a rod cavity of the hydraulic cylinder is connected with a rodless cavity of the hydraulic cylinder, forming a differential circuit with the throttle valve connected; two circuits are formed via the two-position three-way electromagnetic reversing valve: a circuit combining the accumulator, the two-position three-way electromagnetic reversing valve, the throttle valve and the hydraulic cylinder for pushing the inner cylinder of the hydraulic cylinder to extend, and a circuit combining the hydraulic cylinder, the throttle valve, the two-position three-way electromagnetic reversing valve, the filter and the oil tank for pushing the inner cylinder of the hydraulic cylinder to retract; the trip valves are disposed at an outlet end of the hydraulic cylinder and an outlet end of the accumulator; the displacement sensor is used for monitoring the extension length of the inner cylinder of the hydraulic cylinder; the pressure sensors are used for monitoring the pressure of the accumulator, the pressure of the rodless cavity and the rod cavity of the hydraulic cylinder.

4. The linkage test apparatus for deepwater drilling riser and hang-off system of claim 1, wherein the design basis of the riser test joint and the lower marine riser package model are both dynamic similarity principles; the dynamic parameters of the test model are obtained after engineering parameters are scaled down by the same proportion, and the dynamic equation is:

$$M\ddot{x}+C\dot{x}+Kx=F$$

where M is the mass of the riser or lower marine riser package; C is the damping of the riser or lower marine riser package; K is the stiffness of the riser or lower marine riser package; F is the applied force on the riser or lower marine riser package; and x is the displacement of the riser or lower marine riser package.

5. The linkage test apparatus for deepwater drilling riser and hang-off system of claim 4, wherein the riser test joint is designed as multiple sections; a top part is provided with a flange, and a bottom part is provided with a threaded hole; the riser system is assembled through threaded connection, and the threaded connection between a top part of the riser system and the rotating flange is a bolt connection; the lower marine riser package model is composed of counterweight plates; a through hole is provided at the center of the counterweight plate; and a plurality of the counterweight plates are arranged and then connected together via a connecting rod; and an adapter flange is provided at a top of the lower marine riser package model and is connected to the riser system via a screw; and wherein the riser test joint and the lower marine riser package model have the features of easy assembly and disassembly and adjustable parameters.

6. The linkage test apparatus for deepwater drilling riser and hang-off system of claim 1, wherein signals of the displacement sensor, the acceleration sensor arranged in the motion excitation system, the three component force sensor, the acceleration sensor arranged in the riser system, the displacement sensor, the pressure sensor and the strain gauge arranged in the hang-off system are collected by a PLC controller; the throttle valve and the two-position three-way electromagnetic reversing valve are controlled by the PLC controller; the high-performance computer controls the six-degree-of-freedom excitation platform while enabling data reading and command issuing within the PLC controller.

* * * * *